US006102198A

United States Patent [19]

Merrell

[11] Patent Number: 6,102,198

[45] **Date of Patent: *Aug. 15, 2000**

[54] BULK PACKAGING SYSTEM AND METHOD FOR RETARDING CAKING OF ORGANIC AND INORGANIC CHEMICAL COMPOUNDS

[75] Inventor: Philip H. Merrell, Arnold, Mo.

[73] Assignee: Mallinckrodt Inc., St. Louis, Mo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/862,010

[22] Filed: May 22, 1997

[51] Int. Cl.[7] ..... B65D 77/04

[52] U.S. Cl. ..... 206/204; 206/524.4

[58] Field of Search ..... 206/204, 216, 206/524.1, 524.4, 811

[56] References Cited

U.S. PATENT DOCUMENTS

| | | | |
|---|---|---|---|
| 2,674,509 | 4/1954 | Barnet | 206/204 |
| 4,256,770 | 3/1981 | Rainey | 206/204 |
| 4,813,791 | 3/1989 | Cullen et al. | 206/204 X |
| 4,898,273 | 2/1990 | Kristiansen | 206/204 |

*Primary Examiner*—Jacob K. Ackun

*Attorney, Agent, or Firm*—Jonathan P. Soifer; Jeffrey S. Boone

[57] ABSTRACT

A packaging system and method is provided which will substantially retard or reduce the caking of powdered, crystalline, or granular organic and inorganic cakable chemical compounds and mixtures thereof. Such retardation and reduction in caking enhances the free flowability and scoopability of the compound. The packaging system and method comprises a moisture impermeable container, a moisture impermeable cover which closes the container, providing a moisture tight seal between the container and cover such as with a gasket, and desiccant. The compound can be placed directly into the container or into a moisture permeable bag which is sealed after the compound has been placed therein. The bag is filled or sized so that there will be a void space in the container once the container is closed. The desiccant is placed in the void space. The drum may be a fiber board drum having a moisture impermeable liner, such as an aluminum liner. The cover is preferably a plastic cover. The permeable bag is preferably made of kraft crepe paper or woven polypropylene.

29 Claims, 4 Drawing Sheets

BULK PACKAGING SYSTEM AND METHOD FOR RETARDING CAKING OF ORGANIC AND INORGANIC CHEMICAL COMPOUNDS

BACKGROUND

This invention relates to the packaging of bulk quantities of powdered, crystalline or granular organic and inorganic compounds which cake, and in particular a packaging system and method which substantially reduces or eliminates caking of the compounds to maintain the compounds in a substantially free flowing or scoopable state for an extended period of time.

Heretofore, when powdered or crystalline compounds, such as NaCl, KI, $KNO_3$, or other organic or inorganic cakable compounds were packaged in bulk, the compound was normally placed inside a fiberboard drum having a polyethylene liner. The drum was then covered with a fiberboard lid. The compound, when so packaged, invariably cakes, even if measures are taken to prevent or retard caking. In some instances, the compound can cake so severely that it becomes rock solid and must be beaten or crushed before it can be used. This has been especially true of certain salts and other organic and inorganic compounds. Companies spend hundreds of thousands of dollars annually to beat or crush caked compounds so packaged, so that the compounds can be made flowable, or at least scoopable. This severe caking occurs even though desiccant is placed in the drum.

Crushing of caked compounds must, of course, be carried out under controlled circumstances. Procedures must be followed to prevent cross-contamination of compounds and to prevent other impurities from contaminating the compound. This is especially true of drug grade chemicals, the handling of which is governed by the USP. For USP listed chemicals, the chemicals must be processed in accordance with the cGMP (current good manufacturing procedures). Obviously, the need to beat or crush caked compounds adds to the cost of procuring and using the compound. The need to follow the cGMP for crushing a USP listed compound can add even more cost to the process. Beating drums to break up caked compounds is a common practice in the industry. This is an ergonomically and economically poor practice. In can also cause breaking of the drums and allow the products to enter into the environment and/or allow the product to become contaminated.

The caking of chemical compounds has long plagued the industry. Many attempts have been made to alleviate the problem. However, no one has found an acceptable solution. For example in some applications, the compound is heated to 400–500° C. to dry the compound thoroughly before packaging. However, when the moisture leaves the compound in the course of this prior method, it may alter the physical shape and size of the compound in a detrimental manner. Another method includes adding anti-caking agents to the compound to be protected. These anti-caking agents coat the particles of the compound to protect them from moisture. However, a specific anti-caking agent may not be acceptable for a wide variety of compounds. The anti-caking agent therefore must be carefully chosen. Further, the use of anti-caking agents is not acceptable in many circumstances. Pharmaceutical compounds, for example, cannot have anti-caking agents mixed with them. The anti-caking agents can detrimentally alter the efficacy of the resulting medicine, or the process for producing the medicine. The use of anti-caking agents is also costly. The anti-caking agent cannot simply be added to the compound to be protected. It must be fully blended into the compound to be protected. Despite the disadvantages of using anti-caking agents, current research in the prevention or reduction of caking appears to be directed to the development of further anti-caking agents.

The current invention provides an inexpensive and practical solution which substantially reduces or prevents the caking of even KI and $2\mu$ NaCl and maintains the compounds in a substantially free flowing or scoopable state without adding any anti-caking agents to the compound to be protected.

BRIEF SUMMARY OF THE INVENTION

The following are objects of one or more of the claims of the invention:

One object is to provide a packaging system and method for packaging bulk quantities of powdered, crystalline, or granular organic and inorganic cakable compounds and mixtures thereof which will substantially retard or eliminate the caking of the compounds.

Another object is to provide such a packaging system and method which will maintain the chemical compounds in a substantially free flowing or scoopable state.

Yet another object is to provide such a packaging system and method which eliminates or reduces the need to use anti-caking agents.

A further object is to provide such a packaging system and method which will retard caking in a wide variety of compounds.

An additional object is to provide such a packaging system and method which is not complex and which is inexpensive to implement.

These and other objects will become apparent to those skilled in the art in light of the following disclosure and accompanying drawings.

In accordance with the invention, generally stated, a packaging system and method is provided which will substantially reduce the degree of caking of powdered, crystalline, or granular cakable compounds. The packaging system comprises a moisture impermeable container having a moisture impermeable cover which closes the container to define an enclosure in which the compound is placed, and a desiccant. Means, such as a gasket, can be positioned between the container and cover to create a moisture tight seal therebetween. The compound can be placed directly in the container or it can be placed in a moisture permeable bag. The bag, if used, preferably is sealed after the compound has been placed therein. The container is filled with the compound so that there will be a void space in the enclosure. The desiccant is placed in the void space.

The drum is preferably a fiber board drum lined with a moisture impermeable substance, such as aluminum, plastic, etc. The cover is preferably a plastic cover. Any desiccant may be used. It can be, for example, a silicon based desiccant, such as a desiccant which comprises about 70% silicon oxide, about 20% aluminum oxide, about 5% magnesium oxide, about 3% calcium oxide, and about 2% ferric oxide. One commonly available desiccant has a particle size of which 99% by weight passes 10 mesh and 4% passes 80 mesh and has an apparent bulk density of 60 lbs./$ft^3$ (0.96 gm/cc). The permeable bag may be a crepe paper bag, such as a bag made of 50# kraft paper (Arkel™ paper), or it may be a permeable polypropylene bag, such as a bag made from a woven polypropylene.

DETAILED DESCRIPTION OF THE INVENTION

Figure 1:
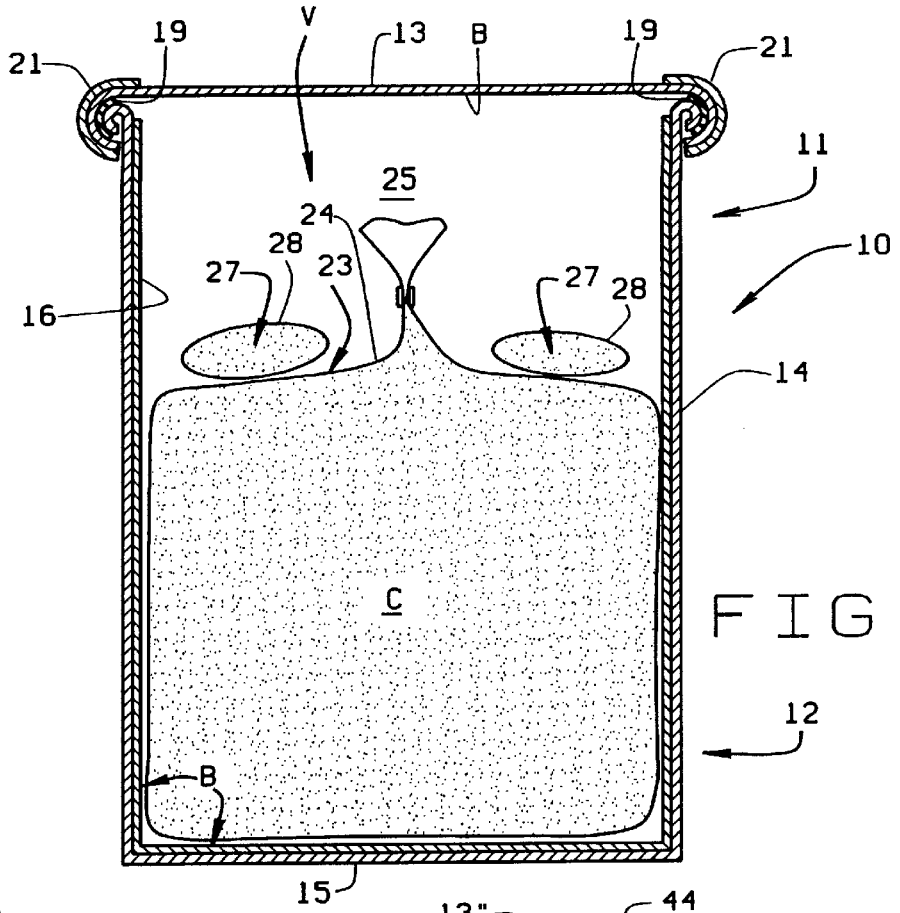
FIG. 1 is a cross-sectional view of an illustrative packaging system of the present invention.

A packaging system 10 of the present invention is shown in FIG. 1. The packaging system 10 comprises a container illustrated as a drum 11. The drum 11 includes a receptacle section 12 and a cover 13. The receptacle section 12 is illustrated as having a cylindrical side wall 14 with a curved annular upper end, and a bottom 15. A moisture impermeable lining 16 covers the side wall 14 and bottom 15 of the drum 11. The drum 11 can be a fiber board drum, and the lining 16 is provided as a moisture barrier to prevent moisture from entering the drum. Although aluminum is preferred for the lining 16 of the drum 11, the drum 11 can be lined with any moisture impermeable substance, including, for example, plastic. The lining 16 is not needed if the drum used is itself moisture impermeable. For example, an aluminum or plastic drum, which acts as, or creates, a moisture barrier could be used without the moisture impermeable lining 16. The cover 13 is moisture impermeable and is preferably made of plastic, but can be made of any moisture impermeable product (such as metal, for example) which will withstand the elements to which the container will be exposed. The cover 13 covers the receptacle 12. Means are provided for forming a moisture tight seal between the cover 13 and the drum receptacle 12. The means can be a gasket 19 made of an elastomer or rubber, for example. The sealing means can also be provided by the cover itself being made of, or including, elastomeric material or rubber, so that it seals at its point of contact with the upper end of the receptacle 12. A lock band 21 is then applied to the receptacle 12 and cover 13 to secure the cover 13 to the receptacle 12. The lock band 21 can be replaced with a tape which will tape closed the container. Once the drum 11 is so closed, moisture is substantially prevented from entering or exiting the drum 11. When the cover 13 is secured to the top of the receptacle 12, the inside surfaces of the cover 13 and of the liner 16 define the surface boundaries B of an enclosed container volume V. If a gas impermeable receptacle is used, then the inside surface of receptacle side wall 14 and bottom 15, and the inside of cover 13 define such boundaries B of volume V.

The chemical compound C is placed for storage in the drum 11. Preferably a moisture permeable bag 23 is first placed within receptacle 12 and then compound C is poured into the bag 23. Alternatively, the bag 23 can be filled with compound C while outside the receptacle 12, then loaded into the receptacle 12. Less desirably, the compound C can be placed directly into the receptacle 12 without bag 23. The bag 23 can be a crepe paper bag made of 50# kraft paper (such as Arkel™ paper), a polypropylene bag, or GOR-TEX® material. If a polypropylene bag is used, the bag is preferably a woven polypropylene bag, such as is available from Essex Plastics of Pompano Beach, Fla. Of course, a moisture permeable polypropylene bag can be formed in other manners, including, for example, perforating a moisture impermeable bag. The receptacle 12 is filled with the compound C (either directly in the drum or in the bag 23) such that there is a head or void space 25 in the volume V. The top of the bag 23 can be closed by a clip 26 which can be of plastic. If the compound C is placed in the bag 23, the void space 25 is defined by the outer wall 24 of the bag 23 and the boundaries B of the volume V. A supply of desiccant 27 is placed in the void space 25. The desiccant 27 is preferably inside moisture permeable bags 28 so that the desiccant particles will not be loose in the drum 11. The bags 28 in which the desiccant 27 is placed will also physically separate the desiccant 27 from the compound C. If the bag 23 is also used, the wall 24 of bag 23 further physically separates the desiccant 27 from compound C. The void space tested was between 10% and 90% of the volume of the drum.

Figure 1A:
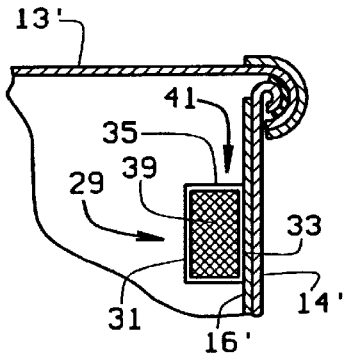
FIG. 1A is a section view, partly broken away, illustrating a modification of the packaging system, showing a basket for holding desiccant mounted to the side of the receptacle lining.

Although the desiccant 27 is shown as placed between the cover 13 and the top of the bag 23 in FIG. 1, the bag 23 could be supported in the drum 11, such that the desiccant 27 is placed at the bottom 15 of the drum 11 and/or adjacent the sides 14 of the drum 11 or adjacent the cover 13. For example, FIGS. 1A and 1B show a modification wherein a basket 29, which can be of plastic, is secured to the inside of the lining 16' as by an adhesive or any other manner which will not affect the moisture impermeable characteristic of the drum 11. The basket 29 can have a frame formed by interior longitudinal struts 31 and exterior longitudinal struts 33 that can be adhered to lining 16'. Struts 31 are connected at their ends to a pair of interior arcuate struts 35. Four transverse struts 37 are connected to the ends of the struts 31 and struts 33. Diagonal strands of cross webs 39 which can be of plastic can be integrally molded with struts 31, 33, 35 and 37 to extend from struts 31, 33 and 37 to make a box-like basket. No cross webs connect the upper struts 37, so that an opening 41 is formed at the top of basket 29. A bag of desiccant such as bag 28 can be inserted through opening 41 into basket 29, with the cross webs 39 at the bottom of basket 29 and the cross webs 39 on three sides of basket 29, along with the lining 16 located toward the outside of basket 29 acting to hold the desiccant bag therein. The strands of webs 39 are spaced apart so that a plurality of holes extend through the webbing to make the webbing 39 moisture permeable and permit ease of gas flow therethrough.

The desiccant bags placed in the basket 29 are thus physically spaced from the compound bag 23. In the case of the receptacle 12' being of moisture impermeable plastic, the basket 29 can be attached to the inside of receptacle side wall 14' as by adhesive, or integrally molded with side wall 14'.

Figure 1C:
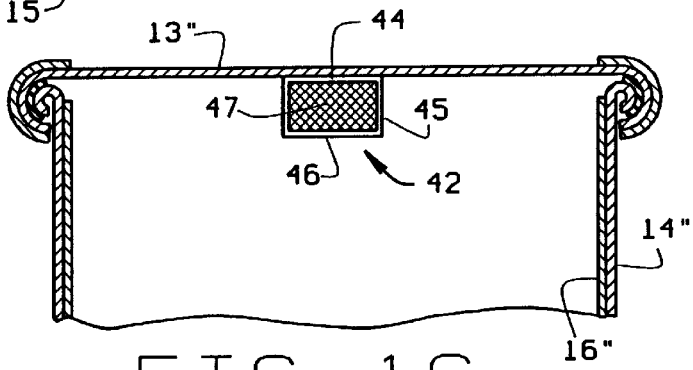
FIG. 1C is a section view, partly broken away, illustrating another modification of the packaging system, showing a basket for holding desiccant that is mounted to the inside of the cover.
Figure 1B:
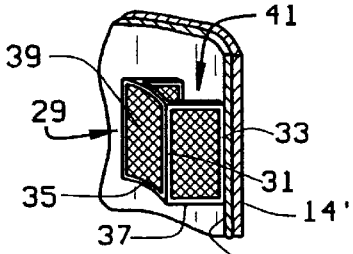
FIG 1B is a orthogonal projection view of the modification showing the basket of FIG. 1A, with some parts broken away.
Figure 1D:
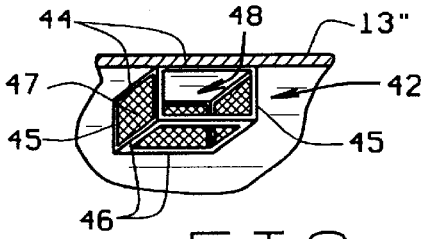
FIG. 1D is a orthogonal projection view of the modification showing the basket of FIG. 1C, with some parts broken away.

FIG. 1C and 1D show another modification where a basket 42 of similar web construction as basket 29 is secured to the inside surface of cover 13" as for example by adhesives or being integrally molded with a plastic cover 13". Basket 42 has four upper struts 44 that form a square frame that can be secured to cover 13". Extending from the ends of the struts 44 are four longitudinal struts 45 that depend downwardly to connect to the ends of four transverse struts 46. Struts 46 also form a square. Webbing 47 is connected to the struts 46 across the basket bottom. Webbing 47 is also connected to struts 44, 45 and 46 on the sides of basket 42 to enclose those sides, except at the front of the basket where an opening 48 is formed at the basket front as viewed in FIG. 1D. A bag of desiccant 27 can be inserted through opening 48 and held within basket 42 to be physically spaced from compound bag 23. In both the embodiments of FIGS. 1A–1D, the baskets are provided in sufficient number and size to contain at least the amount of desiccant desired. In both the embodiments of FIGS. 1A–1D the basket openings could be covered with a pivotally mounted webbed lid and have latches to hold the lid shut.

Figure 2:
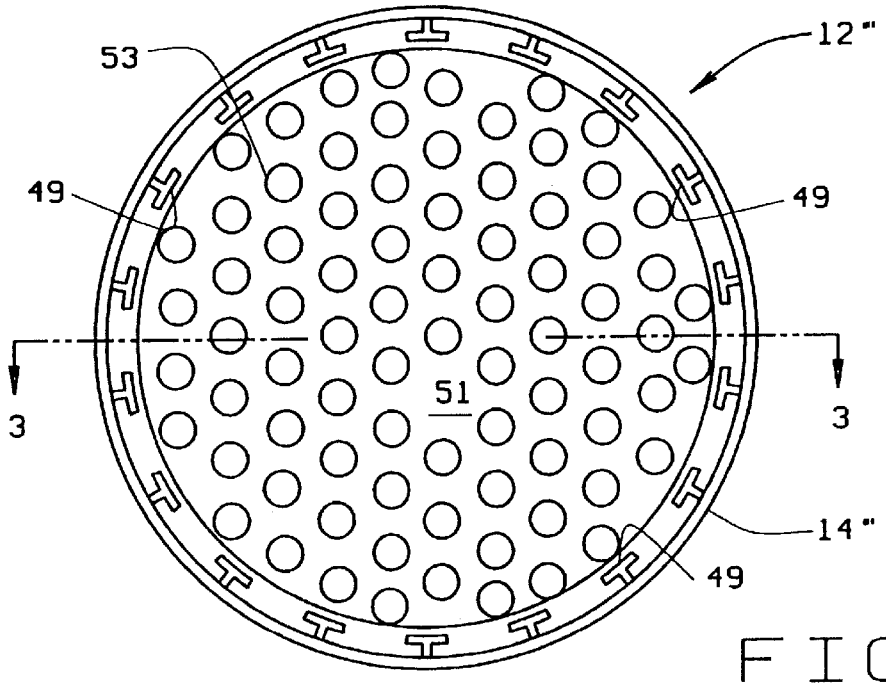
FIG. 2 is a top plan view of a another embodiment of a container of the packaging system with the cover not shown.
Figure 3:
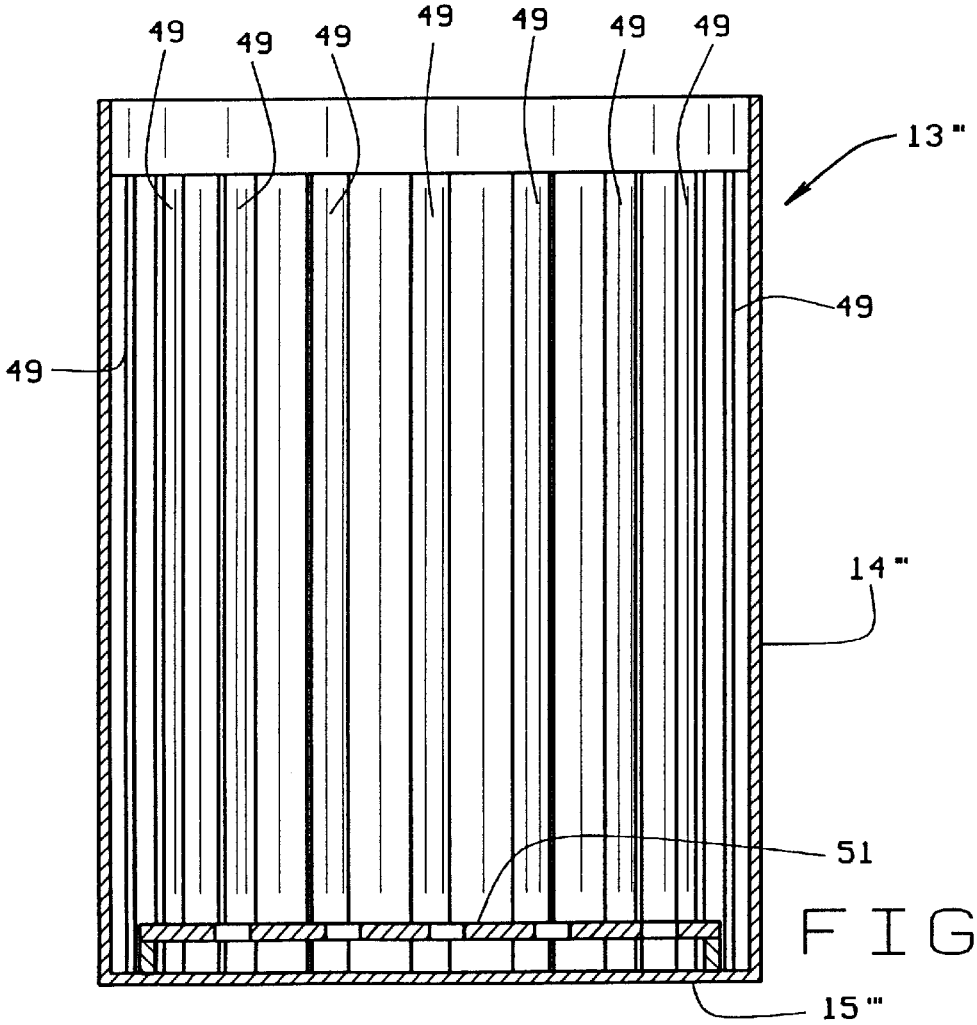
FIG. 3 is a cross-sectional view taken along line 3—3 of FIG. 2.
Figure 4:
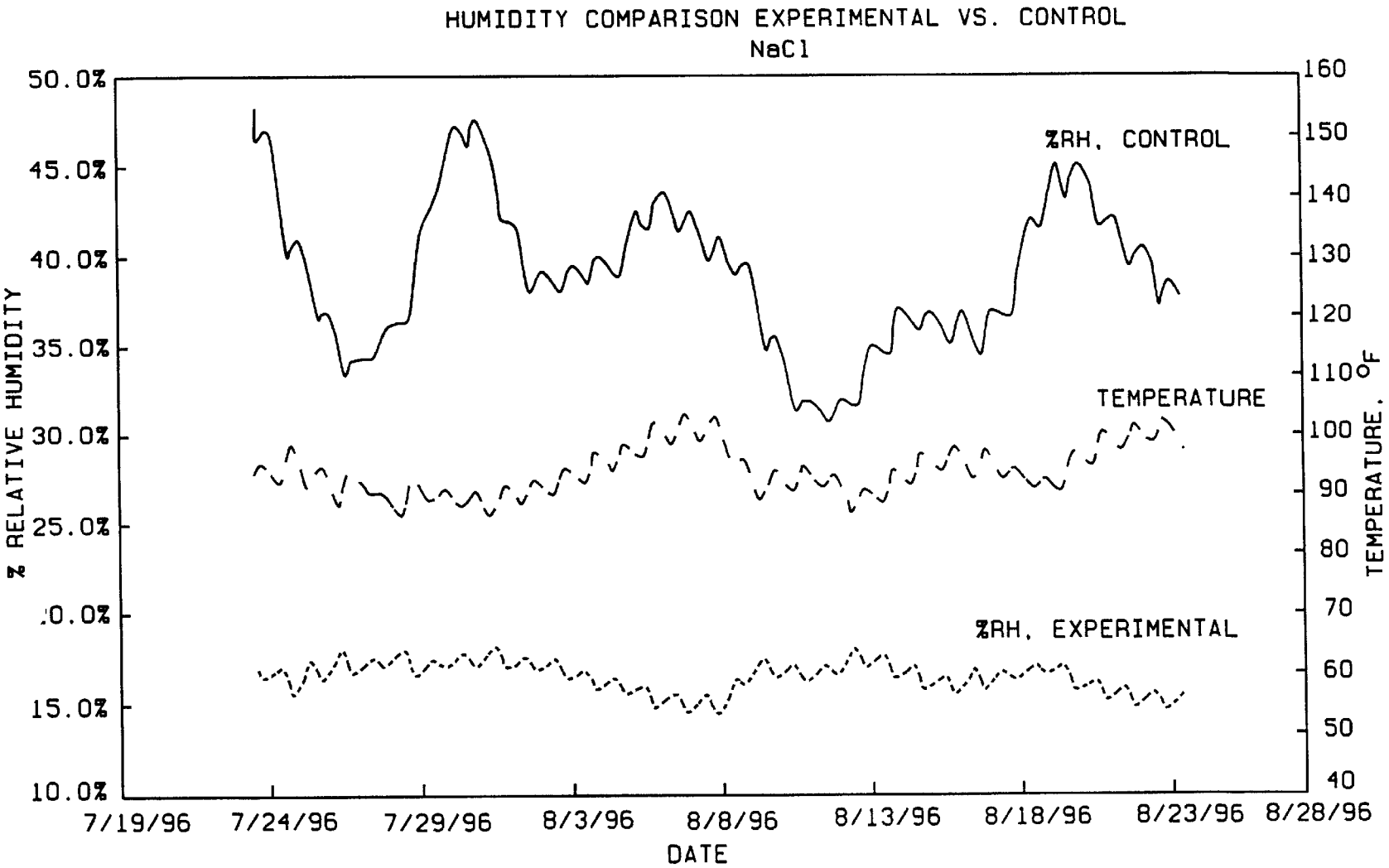
FIG. 4 is a chart comparing the relative humidity in the packaging system of the present invention with conventional packaging.
Figure 5:
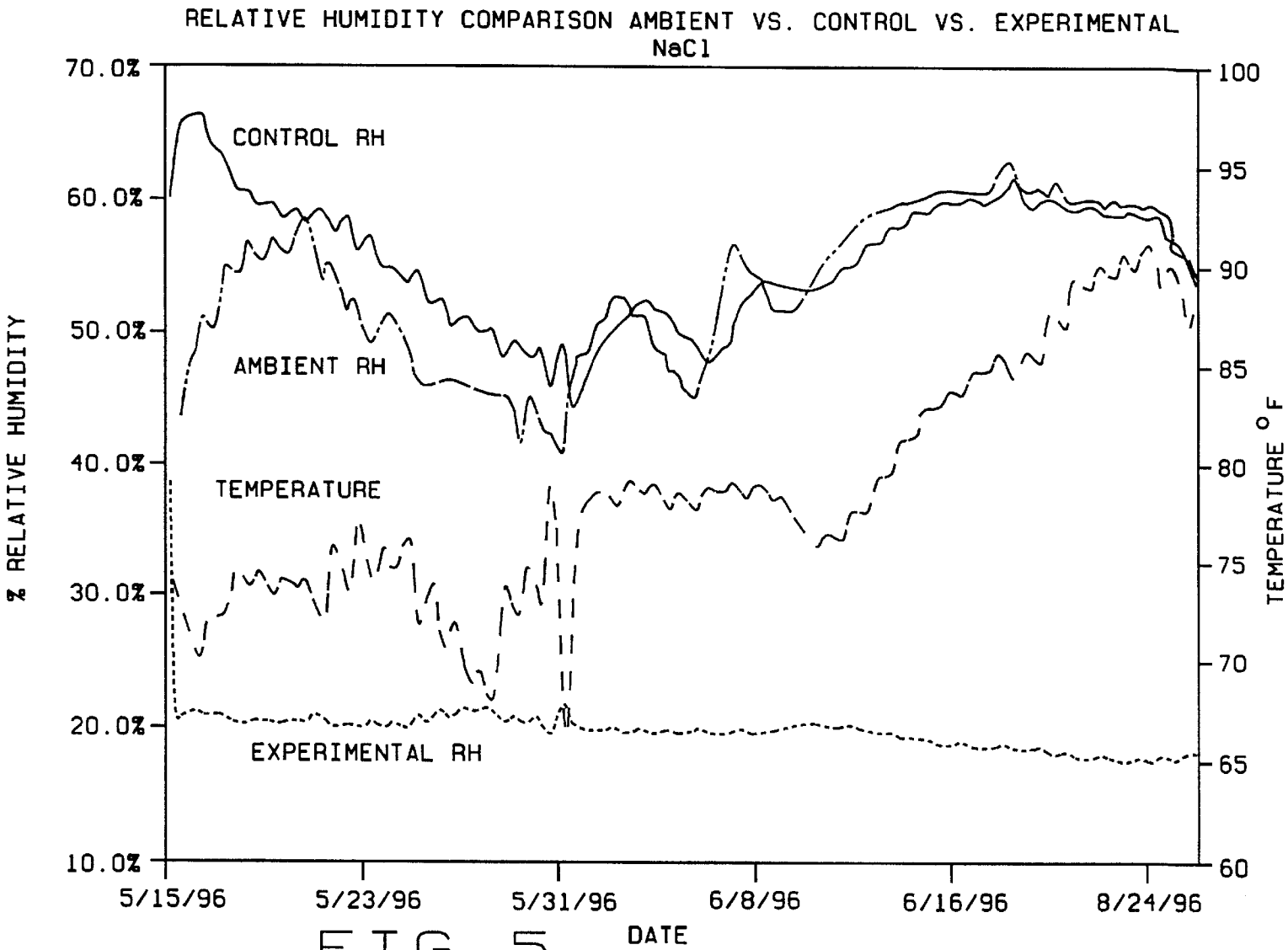
FIG. 5 is a graph charting the relative humidity in the packaging system, the relative humidity in a conventional packaging, and the relative humidity of the ambient atmosphere.

In FIGS. 2 and 3, a drum 11'" is shown which would permit the desiccant to be placed adjacent the sides of the drum 11'" or at the bottom of the drum 11'". The drum 11'" includes vertical ribs 49 (which are shown to be T-shaped in cross-section) extending along the receptacle side wall 14'" and a platform 51 at the bottom 15'" of the receptacle 12'". The ribs 49 and platform 51 would support the compound bag 23 (not shown in FIG. 2–3) in spaced relationship from the receptacle sides 14'" and bottom 15'" such that the void space 25'" would substantially surround the bag 23. To allow moisture to pass through the platform 51, the platform has perforations 53. The platform could also be formed as a plurality of ribs which support the bag 23 above the receptacle bottom 15'". The void space 25'" thus permits gas flow substantially around the bag 23 to facilitate absorption or adsorption of the moisture by the desiccant 17.

In the embodiments shown in FIGS. 2 and 3, the desiccant can be mounted to the inner surfaces of the cover 13'" or sides 14'" of the drum 11'" by use of baskets such as illustrated in FIGS. 1A and 1B. Alternatively, the bags of desiccant can be adhered directly to the surfaces of the cover 13'" or sides 14'" of the drum 11'", for example by taping or gluing the bag 19 of desiccant directly to the desired inner surface of the drum 11'".

The desiccant 27 preferably is a silicon based desiccant, such as Desiccite 25™ available from The Harshaw Chemical Co. of Iselin, N.J. Desiccite 25™ is 70% silicon oxide, 20% aluminum oxide, 5% magnesium oxide, 3% calcium oxide, and 2% ferric oxide. It has a particle size 99% by weight of which passes 10 mesh and 4% by weight of which passes 80 mesh and an apparent bulk density of 60 lbs./ft$^3$ (0.96 gm/cc). The water vapor absorption characteristics of the desiccant, at equilibrium at 77° F. (25° C.) are as follows:

| % Relative Humidity | Wt % water absorbed |
|---|---|
| 80 | 26 |
| 60 | 21 |
| 40 | 18 |
| 20 | 9 |

This desiccant is available in bags of 8 to 80 units each. Under military specification MIL-D-3464-E, a unit of desiccant is the amount of desiccant which will absorb or adsorb in seven hours at 25° C. 3 gm of water at 20% relative humidity, and 6 gm of water at 40% relative humidity. Thirty-three grams (33 gm) of the Desiccite 25™ is equivalent to one unit of desiccant. The amount of desiccant needed in each package depends on the amount of moisture that will be trapped in the drum when the drum is sealed. I have found that two bags (eighteen units) of the desiccant in the drum works well for up to at least 100 lbs of compound with less than 0.1% moisture. The desiccant was added at a ratio of 0.16 to 1.6 units of desiccant per pound of compound. Less desiccant may also have worked equally as well. The exact amount (i.e., weight) of desiccant needed to extract the moisture from the compound depends, among other factors, the actual amount of free moisture in the compound, the humidity of the air in the drum, the efficacy of the drum desiccant, etc. The eighteen units of desiccant used is believed to be in excess of the amount actually needed for 100 pounds at 0.1% moisture. However, the use of an excess amount of desiccant is preferred to ensure that the moisture which would otherwise lead to caking of the compound will be absorbed or adsorbed by the desiccant. Of course, the desiccant is preferably dry (i.e., not loaded with moisture) when it is placed in the drum 11.

Although the tests conducted were performed with the Desiccite 25™ (a silica based desiccant), any other desiccant should work. Such other desiccants include, for example, silica gel, activated alumina (AlO), barium oxide (BaO), calcium chloride ($CaCl_2$), calcium oxide (CaO), calcium sulfate ($CaSO_4$), lithium chloride (LiCl), perchlorates (such as barium perchlorate [$Ba(ClO_4)_2$], lithium perchlorate [$LiClO_4$], and magnesium perchlorate [$Mg(ClO_4)_2$]), phosphorus pentoxide ($P_2O_5$), sodium (NaOH) and potassium (KOH) hydroxides, and molecular sieves. This list is not meant to be exclusive, and other desiccants could also work equally well or better than those listed. Of course, the desiccant chosen should preferably be inert with respect to the compound being stored in the drum 11.

EXAMPLES

In the following examples, the noted compounds were placed in a packaging system of the present invention and a control sample was placed in a conventionally packaging system (such as outlined above) at the same time. The chemical compounds were free flowing when placed in the packaging systems. The experimental and control samples for the different compounds tested were stored adjacent each other throughout the experiment so that they would be subject to the same conditions. The drum contents were checked on the noted dates to determine the condition of the powder contained therein. The compounds were evaluated according to the following schedule:

1 free flowing, no evidence of caking
2 free flowing, faint crusting on surface only
3 free flowing, some soft friable balls
4 some crusting, small difficulty in scooping
5 more crusting, scooping possible only on the surface
6 even more crusting
7 much pressure necessary to break into lumps
8 product must be hit to break into lumps
9 product must be beaten to get lumps, and such lumps are very hard
10 hammer and screwdriver required to push into the product According to this schedule, any compound which rates a 5 or less is acceptable. If the compound rates a 7 or greater, the compound must then be processed to make it at least scoopable. Whether or not a compound cakes to a rating of 6 is acceptable or needs further processing depends upon the amount of crusting and its scoopability. The examples are tabulated below in Table I. Those examples that include a "C" in their number are controls. Except where noted, the drums used were cylindrical in shape.

TABLE I

| Ex | Product | Drum Size (Gal.) | Drum Size Diam. × Ht (In) | Drum Material | Bag Material | Head Space (In) | Amount Of Compound (lbs.) | Amount Of Desiccant (units) | Duration (days) | Deg. Caked | Notes |
|---|---|---|---|---|---|---|---|---|---|---|---|
| 1 | NaCl | 41 | 20 × 30 | Al† | Arkel | 24–26 | 100 | 16 | 154 | 1 | |
| 2C | NaCl | 15.5 | 14 × 23.25 | Fiber | Polyethylene | 3–5 | 100 | 0 | 25 | 8 | |
| 3C | NaCl | 15.5 | 14 × 23.25 | Fiber | Polyethylene | 3–5 | 100 | 0 | 10 | 6 | |
| 4 | NaCl | 15.5 | 14 × 23.25 | Al | Arkel | 3–5 | 100 | 16 | 27 | 1 | |
| 5 | NaCl | 15.5 | 14 × 23.25 | Al | Arkel | 3–5 | 100 | 16 | 65 | 1 | |
| 6 | NaCl | 15.5 | 14 × 23.25 | Al | Poly-propylene | 3–5 | 100 | 16 | 65 | 1 | |
| 7 | NaCl | 15.5 | 14 × 23.25 | Al | Arkel | 3–5 | 100 | 16 | 65 | 1 | |
| 8 | NaCl | 15.5 | 14 × 23.25 | Al | Poly-propylene | 3–5 | 100 | 16 | 91 | 1 | |
| 9 | NaCl | 15.5 | 14 × 23.25 | Al | Arkel | 3–5 | 100 | 16 | 91 | 1 | |
| 10 | NaCl | 15.5 | 14 × 23.25 | Al | Arkel | 3–5 | 100 | 16 | 91 | 1 | |
| 11C | NaCl | 15.5 | 14 × 23.25 | Fiber | Polyethylene | 3–5 | 100 | 0 | 65 | 7 | |
| 12C | NaCl | 15.5 | 14 × 23.25 | Fiber | Polyethylene | 3–5 | 100 | 0 | 65 | 3 | |
| 13 | NaCl | 15.5 | 14 × 23.25 | Fiber | Arkel | 3–5 | 100 | 16 | 69 | 2 | |
| | | | | | | | | | 100 | 2 | |
| 14 | NaCl | 41 | 20 × 30 | Poly-drum | Poly-propylene | 25–28 | 100 | 16 | 69 | 1 | |
| | | | | | | | | | 100 | 1 | |
| 15C | NaCl | 15.5 | 14 × 23.25 | Fiber | Arkel | 3–5 | 100 | 0 | 69 | 6 | |
| | | | | | | | | | 100 | 6 | |
| 16C | NaCl | 15.5 | 14 × 23.25 | Fiber | Polyethylene | 3–5 | 100 | 0 | 69 | 4 | |
| 17 | NaCl 2$\mu$ | 8.5 | 14.25 × 12.3 | Al | Arkel | 1–3 | 40 | 16 | 15 | 1 | checked to |
| | | | | | | | | | 34 | 1 | bottom of drum |
| | | | | | | | | | 111 | 1 | - no corrosion as |
| | | | | | | | | | 142 | 1 | of 365 days |
| | | | | | | | | | 365 | 1 | |
| 18C | NaCl 2$\mu$ | 1 | | Fiber Box | Polyethylene | 1–3 | 10 | 0 | 15 | 8 | |
| 19 | ZPS* | 8.5 | 14.25 × 12.3 | Al | Arkel | 4–6 | 60 | 16 | 57 | 1 | |
| | | | | | | | | | 93 | 1 | |
| | | | | | | | | | 119 | 1 | |
| | | | | | | | | | 156 | 2 | |
| | | | | | | | | | 196 | 2 | |
| | | | | | | | | | 227 | 3 | |
| 20C | ZPS | 41 | 20 × 30 | Fiber | Polyethylene | 3–5 | 100 | 0 | 76 | 5 | |
| 21 | $KNO_3$ | 8.5 | 14.25 × 12.3 | Al | Arkel | 3–5 | 60 | 16 | 58 | 3 | Condition after |
| | | | | | | | | | 94 | 3 | 228 days a little |
| | | | | | | | | | 120 | 3 | harder than at |
| | | | | | | | | | 157 | 3 | 197 days |
| | | | | | | | | | 197 | 3 | |
| | | | | | | | | | 228 | 4 | |
| 22C | $KNO_3$ | 15.5 | 14 × 23.25 | Fiber | Arkel | 3–5 | 100 | 16 | 73 | 8 | Very Hard |
| 23 | $KNO_3$ | 8.5 | 14.25 × 12.3 | Al | Arkel | 3–5 | 60 | 16 | 8 | 3 | soft lumps |
| 24C | $KNO_3$ | 15.5 | 14 × 23.25 | Fiber | Arkel | 3–5 | 100 | 0 | 8 | 6 | |
| 25 | $Na_2HPO_4$ | 8.5 | 14.25 × 12.3 | Al | Arkel | 3–5 | 40 | 16 | 21 | 1 | |
| | | | | | | | | | 57 | 1 | |
| | | | | | | | | | 83 | 1 | |
| | | | | | | | | | 191 | 1 | |
| 26C | $Na_2HPO_4$ | 8.5 | 14.25 × 12.3 | Fiber | Polyethylene | 3–5 | 100 | 0 | 57 | 1 | |
| | | | | | | | | | 191 | 1 | |
| 27 | $Na_2CO_3$ | 8.5 | 14.25 × 12.3 | Al | Arkel | 5–7 | 40 | 16 | 50 | 1 | Free Flowing |
| | | | | | | | | | 86 | 2 | Soft Lumps |
| | | | | | | | | | 112 | | |
| | | | | | | | | | 149 | 1 | |
| | | | | | | | | | 189 | 2 | |
| | | | | | | | | | 220 | 3 | |
| 28 | $K_2CO_3$ Powder | 8.5 | 14.25 × 12.3 | Al | Arkel | 2–9 | 100 | 16 | 22 | 1 | |
| | | | | | | | | | 85 | 2 | |
| | | | | | | | | | 152 | 1 | |
| | | | | | | | | | 183 | 2 | |
| 29 | $Bi(NO_3)_3$-$5H_2O$ | 8.5 | 14.25 × 12.3 | Al | Arkel | 2–9 | 40 | 16 | 69 | 1 | Arkel liner decomposed |
| 30 | Guanidine Hydrochloride | 8.5 | 14.25 × 12.3 | Poly-ethylene | Poly-propylene | 3–5 57 | 15 3 | 16 | 14 | 2 | |
| 31 | Guanidine Hydro-chloride | 8.5 | 14.25 × 12.3 | Al | Arkel | 3–5 | 15 | 16 | 14 | 1 | |
| | | | | | | | | | 57 | 1 | |
| 32 | Guanidine Hydro-chloride | 8.5 | 14.25 × 12.3 | Poly-ethylene | Arkel | 3–5 | 15 | 16 | 14 | 1 | |
| | | | | | | | | | 57 | 1 | |
| 33C | Guanidine Hydro-chloride | 5 | 14 × 11 | Poly-ethylene | two poly-ethylene | 3–5 | 15 | 16 | 14 | 6 | |
| | | | | | | | | | 57 | 7 | |
| 34C | Guanidine Hydro-chloride | 5 | 14 × 11 | Fiber ethylene | two poly- | 3–5 | 15 | 16 | 14 | 6 | |
| | | | | | | | | | 57 | 7 | |
| 35C | Guanidine Hydro-chloride | 5 | 14 × 11 | Poly-ethylene | polyethylene | 3–5 | 15 | 16 | 14 | 5 | |
| | | | | | | | | | 57 | 7 | |
| 36 | KI Powder | 8.5 | 14.25 × 12.3 | Al | Arkel | 3–5 | 90 | 16 | 13 | 1 | |
| | | | | | | | | | 24 | 1 | |

TABLE I-continued

| Ex | Product | Drum Size (Gal.) | Drum Size Diam. × Ht (In) | Drum Material | Bag Material | Head Space (In) | Amount Of Compound (lbs.) | Amount Of Desiccant (units) | Duration (days) | Deg. Caked | Notes |
|---|---|---|---|---|---|---|---|---|---|---|---|
| | | | | | | | | | 50 | 1 | |
| | | | | | | | | | 90 | 3 | |
| | | | | | | | | | 121 | 4 | |
| 37C | KI Powder | 10 | 14 × 22 | Fiber | Polyethylene Tape | 3–5 | 100 | 0 | 13 | 9 | |
| 38 | KNCS | 8.5 | 14 × 12.3 | Al | Arkel | 3–5 | 50 | 16 | 50 | 6 | |
| 39C | KNCS | 8.5 | 14 × 12.3 | Fiber | Polyethylene | 3–5 | 50 | 16 | 50 | 6 | |
| 40 | NaOAc | 8.5 | 14 × 12.3 | Al | Arkel | 3–5 | 100 | 16 | 10 | 1 | |
| | | | | | | | | | 50 | 1 | |
| | | | | | | | | | 81 | 1 | |
| 41C | NaOAc | 8.5 | 14 × 12.3 | Fiber | Polyethylene | 3–5 | 100 | 0 | 10 | 3 | |
| | | | | | | | | | 81 | 4 | |
| 42 | $Na_2SO_4$ | 8.5 | 14 × 12.3 | Al | Arkel | 3–5 | 50 | 16 | 6 | 1 | |
| | | | | | | | | | 46 | 1 | |
| | | | | | | | | | 77 | 1 | |
| 43C | $Na_2SO_4$ | 15 | 15.5 × 18.5 | Fiber | Polyethylene | 5–8 | 100 | 0 | 6 | 1 | |
| | | | | | | | | | 46 | 1 | |
| | | | | | | | | | 77 | 1 | |
| 44 | KCl | 8.5 | 14 × 23.25 | Al | Arkel | 3–5 | 50 | 16 | 7 | 1 | |
| | | | | | | | | | 21 | 1 | |
| | | | | | | | | | 61 | 2 | |
| | | | | | | | | | 89 | 3 | |
| 45C | KCl | 31 | 17 × 31.75 | Fiber | Arkel | 5–8 | 250 | 16 | 7 | 5 | |
| | | | | | | | | | 21 | 6 | |
| | | | | | | | | | 61 | 8 | |
| | | | | | | | | | 89 | 8 | |
| 46 | KCl | 15.5 | 14 × 23.25 | Al | Arkel | 5–8 | 50 | 16 | 7 | 4 | |
| | | | | | | | | | 21 | 3 | |
| | | | | | | | | | 61 | 3 | |
| | | | | | | | | | 103 | 3 | |
| 47C | KCl | I5.5 | 14 × 23.25 | Fiber | Arkel | 5–8 | 250 | 16 | 7 | 4 | |
| | | | | | | | | | 21 | 5 | |
| | | | | | | | | | 61 | 6 | |
| | | | | | | | | | 103 | 6 | |
| 48 | KCl | 15.5 | 14 × 23.25 | Al | Arkel | 3–5 | 50 | 16 | 39 | 2 | |
| | | | | | | | | | 81 | 2 | |
| 49C | KCl | 31 | 17 × 31.75 | Fiber | Arkel | 5–8 | 250 | 0 | 39 | 5 | |
| | | | | | | | | | 81 | 5 | |
| 50C | Sodium Nitrate | 8.5 | 14.25 × 12.3 | Plastic | Polyethylene | 5–8 | 100 | 0 | 48 | 9 | |
| 51 | Sodium Nitrate | 8.5 | 14.25 × 12.3 | Al | Arkel | 5–8 | 100 | 16 | 48 | 2 | |
| 52C | KF | 8.5 | 14.25 × 12.3 | Plastic | Polyethylene | 5–8 | 100 | 0 | 87 | 7 | |
| 53 | KF | 8.5 | 14.25 × 12.3 | AT | Arkel | 5–8 | 100 | 16 | 87 | 2 | |
| 54C | Ammonium Phosphate Dibasic Anhydrous | 8.5 | 14.25 × 12.3 | Plastic | Polyethylene | 5–8 | 100 | 0 | 26 | 4 | |
| 55 | Ammonium Phosphate Dibasic Anhydrous | 8.5 | 14.25 × 12.3 | Al | Arkel | 5–8 | 100 | 16 | 26 | 1 | |
| 56 | Urea | 20 | 17 × 30 | Al | Arkel | 6–8 | 50 | 16 | 63 | 1 | |
| 56C | Urea | 20 | 17 × 30 | Fiber | Polyethylene | 6–8 | 50 | 0 | 63 | 8 | |

†The drums marked as Al are fiber drums with an aluminum liner.
*ZPS is Zinc Phenol Sulfonate The experiments surprisingly showed that even the compounds which are known to cake nearly instantaneously remained free-flowing when packaged in the drum of the present invention, whereas the same compound caked severely when packaged in the conventional drum. For instance, 2$\mu$ NaCl is known to cake very quickly. Its extremely small size creates a significant amount of surface area which accelerates the caking process. Example 17 shows that 40 lbs of 2$\mu$ NaCl remained free flowing, even after almost one year in the drum of the present invention, whereas 10 lbs of 2$\mu$ NaCl caked to the point that it must be hit to break it into lumps within only two weeks in the control sample (Example 18C). KI is another compound that is known to cake readily. In Example 37C, it can be seen that within merely 13 days the KI caked to the point where it had to be beaten just to break it into lumps. Whereas in the packaging system of the present invention the KI remained free flowing, even after almost four months. (See Example 36).

The potassium nitrate ($KNO_3$) tests (Examples 21 and 22C) were both performed with the compound in Arkel paper (i.e., moisture permeable) bags. The only difference between the two was that in Example 21, the fiber drum was lined with aluminum to make the receptacle moisture impermeable. The control test (Example 22C) included the same amount of desiccant as the test sample (Example 21). Without the moisture barrier to prevent moisture from entering the container, it can be seen that the compound to be protected will cake.

In the bismuth nitrate pentahydrate ($Bi(NO_3)_3 \cdot 5H_2O$) test (Example 29), the paper liner disintegrated. The disintegration of the liner however did not affect the results, and the compound remained free flowing, even after two months. Even though the compound was originally placed in a bag, this example demonstrates that a bag is not necessary for the operation of the system, and that the compound can be placed directly in the drum. Bismuth nitrate pentahydrate is not hydrophilic, hygroscopic, nor water soluble, yet it cakes severely. Thus, my packaging system works for at least some compounds that are not water soluble, hydrophilic, nor hygroscopic.

The series of tests on the guanidine hydrochloride (Examples 30–35C) indicated that the liner or bag in which the compound is placed is important. In the tests in which the guanidine hydrochloride was placed in polyethylene liners (i.e. essentially water impermeable liners) the product caked, even though desiccant was placed in the receptacle with the bag of product. The tests also show that receptacles made of materials other than aluminum lined drums will work well. In Example 30, a polyethylene receptacle was used without a lining 16. The receptacle used was one available from The United States Can Company (formerly The Sherwin-Williams Company) of Cleveland Ohio under the name POLY-PAIL®. Polyethylene is known to be moisture impermeable and thus the lining 16 was not needed.

In the potassium thiocyanate (KSCN) tests (Examples 38 and 39C), the compound placed in my packaging system and the compound in the control both caked to the same degree. Thus, my packaging system did not reduce caking of this particular compound. It is not known why the packaging system did not reduce or retard caking of the KSCN. It could have been caused by several factors, one of which is the mechanism by which KSCN cakes. The mechanism by which KSCN cakes may be sufficiently different from the other compounds to prevent my packaging system from retarding caking for KSCN.

What makes the results even more surprising, is that the powder remained free flowing or scoopable even at the bottom of the drum, where the chemical was farthest from the desiccant.

As variations within the scope of the appended claims may be apparent to those skilled in the art, the foregoing description is set forth only for illustrative purposes and is not meant to be limiting. The tests were carried out primarily in cylindrical drums. However, containers of any shape may be used. Although the packaging system was described for use with, and tested with, individual compounds, it is also applicable for use with mixtures of the compounds. These examples are merely illustrative.

What is claimed is:

1. A packaging system for powdered, crystalline, or granular cakable compounds and mixtures thereof to retard caking of the compound, the packaging system comprising:

(a) a moisture impermeable container having a receptacle and a removable cover, the receptacle and cover defining an enclosure, the enclosure having a volume of at least 5 gallons;

(b) means for creating a moisture tight seal between the receptacle and the cover;

(c) a cakable compound located within the enclosure, the cakable compound in the enclosure having a volume, the volume of the compound being less than the volume of the enclosure to define a void space in the enclosure; and (d) a desiccant, the desiccant being placed in the void space; at least one of the desiccant and the cakable compound being contained in a moisture permeable bag to physically separate said desiccant from said compound.

2. The packaging system of claim 1 wherein the cakable compound is placed in the moisture permeable bag, the bag being sealed to hold the compound therein.

3. The packaging system of claim 1 wherein the receptacle comprises a fiberboard receptacle, the receptacle having an moisture impermeable lining.

4. The packaging system of claim 3 wherein the cover is comprised of plastic.

5. The packaging system of claim 1 wherein the desiccant is a silicon based desiccant.

6. The packaging of claim 5 wherein the desiccant:

(a) comprises about 70% silicon oxide, about 20% aluminum oxide, about 5% magnesium oxide, about 3% calcium oxide, and about 2% ferric oxide;

(b) has a particle size 99% by weight of which passes 10 mesh and 4% of which passes 80 mesh; and (c) has an apparent bulk density of 60 lbs./$ft^3$(0.96 gm/cc).

7. The packaging system of claim 2 wherein the permeable bag is made of paper or polypropylene.

8. The packaging system of claim 1 wherein the means for creating a moisture tight seal comprises a gasket.

9. The packaging system of claim 1 wherein the void space is between approximately 10% and approximately 90% of the volume of the container.

10. The packaging system of claim 1 wherein there less than 1.8 units of desiccant per pound of compound in the container.

11. The packaging system of claim 1 wherein the desiccant is contained within a moisture permeable bag.

12. The packaging system of claim 11 wherein the compound is contained within a moisture permeable bag, the bag being sealed to hold the compound therein.

13. The packaging system of claim 11 further comprising means for mounting the bag of desiccant to be spaced from the compound bag.

14. The packaging system of claim 13 wherein the means for mounting the desiccant bag comprises a moisture permeable basket mounted to the container, the moisture permeable basket being sized and shaped to receive the bag of desiccant.

15. A packaging system used for storing bulk quantities of a cakable compound and which will retard the caking of the compound, the packaging system comprising:

(a) a moisture impermeable container having moisture impermeable receptacle which is closed by a moisture impermeable cover, the container and cover defining a volume of at least 5 gallons;

(b) a cakable compound positioned within the volume of the container and cover, the compound having a volume, the volume of the compound in the container being less then the volume of the container such that there is a void space in the container; and (c) a desiccant positioned in the void space, the desiccant and compound being physically separated; there being approximately 0.16 to approximately 1.6 units of desiccant per pound of compound in the container.

16. The packaging system of claim 15 wherein the void space defines a volume, the volume of the void space being between 10% and 90% of the volume of the container.

17. The packaging system of claim 15 wherein the desiccant is carried in a moisture permeable bag, with at least the desiccant bag separating the desiccant from the compound.

18. The packaging system of claim 15 wherein the compound is placed in a moisture permeable bag, the bag in which the compound is placed being sealed.

19. The packaging system of claim 15 further comprising a moisture permeable basket mounted to an inner surface of the container, the basket receiving the desiccant to separate the desiccant from the compound.

20. The packaging system of claim 19 wherein the receptacle has a side wall and wherein the basket is mounted to the side wall of the receptacle.

21. The packaging system of claim 19 wherein the basket is mounted to the cover.

22. A packaging system for storing powder, crystalline, or granular cakable compounds to retard caking of the compound stored in the packaging system, the packaging system comprising:

(a) a moisture impermeable container having a receptacle and a removable cover, the receptacle and cover defining an enclosure, the enclosure having a volume of at least 5 gallons;

(b) means for creating a moisture tight seal between the receptacle and the cover;

(c) a first moisture permeable bag containing the compound, the bag being sealed to hold the compound therein, the compound and the bag in the enclosure having a volume, the volume of the compound and its bag being less than the volume of the enclosure to define a void space in the enclosure; and (d) a second moisture permeable bag containing desiccant, the desiccant bag being placed in the void space.

23. The packaging system of claim 18 wherein the packaging system stores a bulk quantity of the compound.

24. The packaging system of claim 23 wherein the volume of the enclosure is at least 5 gallons.

25. A packaging system for powdered, crystalline, or granular cakable compounds to retard caking of the compound, the packaging system comprising:

(a) a moisture impermeable container having a receptacle and a removable cover, the receptacle and cover defining an enclosure, the enclosure having a volume of at least 5 gallons;

(b) means for creating a moisture tight seal between the receptacle and the cover;

(c) a powdered, crystalline, or granular cakable compound located within the enclosure, the cakable compound in the enclosure having a volume, the volume of the compound being less than the volume of the enclosure to define a void space in the enclosure; and (d) a desiccant, the desiccant being placed in the void space; at least one of the desiccant and the cakable compound being contained in a moisture permeable bag to physically separate the desiccant from the compound.

26. The packaging system of claim 1 wherein the receptacle and cover define an enclosure having a volume of at least 8.5 gallons.

27. The packaging system of claim 15 wherein the receptacle and cover define an enclosure having a volume of at least 8.5 gallons.

28. The packaging system of claim 22 wherein the receptacle and cover define an enclosure having a volume of at least 8.5 gallons.

29. The packaging system of cliam 25 wherein the receptacle and cover define an enclosure having a volume of at least 8.5 gallons.

* * * * *